US005329702A

United States Patent [19]

Uchiyama et al.

[11] Patent Number: 5,329,702

[45] Date of Patent: Jul. 19, 1994

[54] ELECTRIC RAZOR

[75] Inventors: Hiromi Uchiyama; Masaki Okabe, both of Nagano, Japan

[73] Assignee: Izumi Products Company, Nagano, Japan

[21] Appl. No.: 25,971

[22] Filed: Mar. 3, 1993

[30] Foreign Application Priority Data

Apr. 17, 1992 [JP] Japan ..... 4-125694

[51] Int. Cl.[5] ..... B26B 19/04

[52] U.S. Cl. ..... 30/346.51

[58] Field of Search ..... 30/346.51, 346.5, 43.5, 30/43.6

[56] References Cited

U.S. PATENT DOCUMENTS 3,636,626 1/1972 Zuurveen ..... 30/346.51
3,800,417 4/1974 Tietjens ..... 30/346.51
3,919,770 11/1975 Sakai et al. ..... 30/346.51
4,393,586 7/1983 Hamashima et al. ..... 30/346.51
4,630,370 12/1986 Hamada ..... 30/346.51

FOREIGN PATENT DOCUMENTS 615670 1/1949 United Kingdom ..... 30/346.51

*Primary Examiner*—Richard K. Seidel
*Assistant Examiner*—Paul M. Heyrana, Sr
*Attorney, Agent, or Firm*—Koda and Androlia

[57] ABSTRACT

An electric razor with round external cutting members and round internal cutting members with cutters at the end of uneven length arms. Each one of the external cutting members has concentric circular shaving sections obtained by concentric grooves, and the backs of the circular shaving sections are defined as tracks so that cutters of the internal cutting member are rotated in the tracks. The external cutting member is formed with slits which are substantially in a radial direction and uneven in the length.

11 Claims, 2 Drawing Sheets

FIG. 3
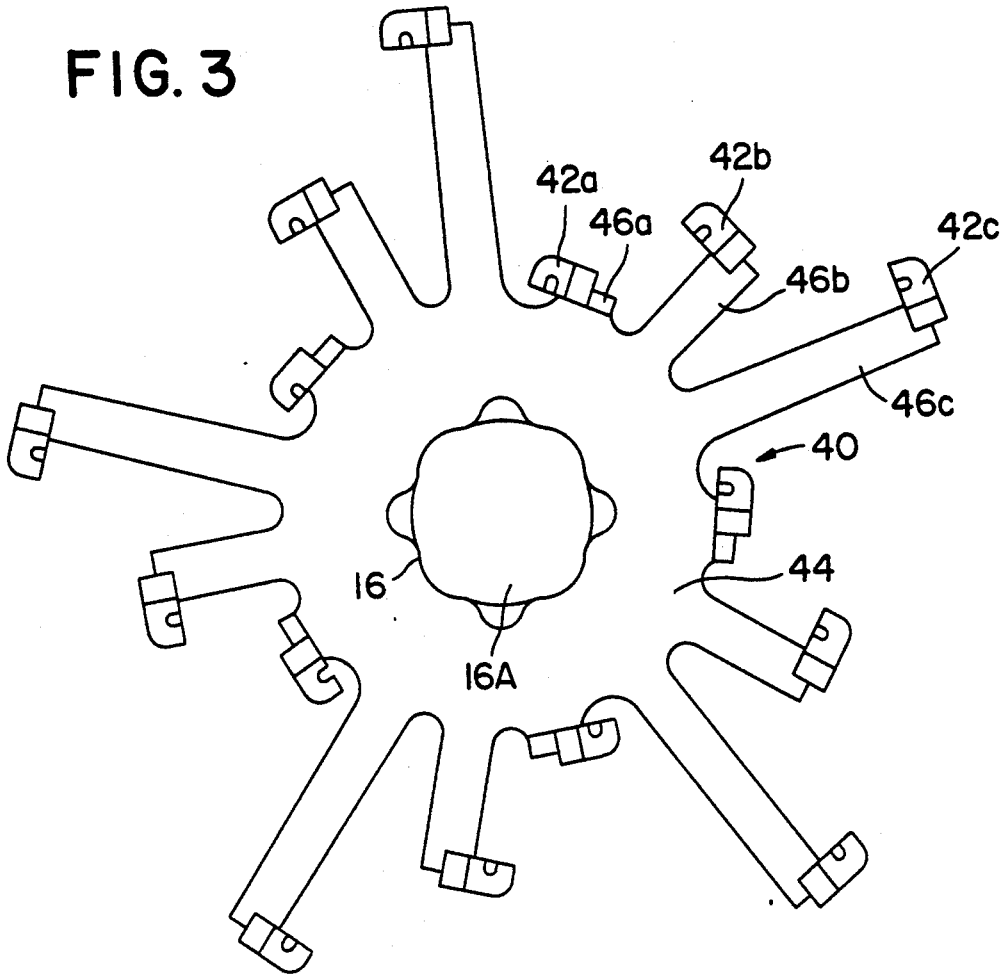
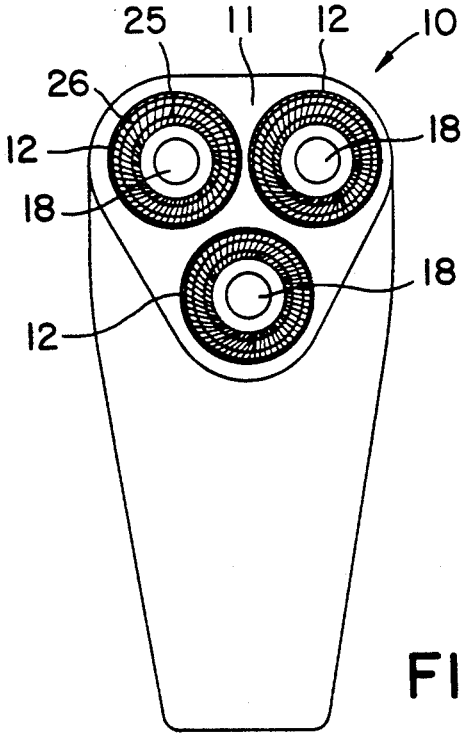
FIG. 4
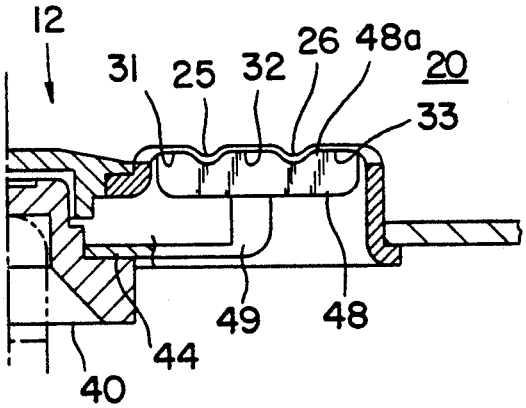
FIG. 5

ELECTRIC RAZOR

BACKGROUND OF THE INVENTION

1. Field of the Invention

The present invention relates to an electric razor and more particularly to a multiple track electric razor with external cutting members that have hair-entry slits.

2. Prior Art

Japanese Patent Application Publication (Kokoku) No. 41-14339 is one example that discloses an external cutting member for an electric razor that has two concentric circular shaving sections.

In the external cutting member of this prior art, a partition groove that divides the shaving surface into inner and outer shaving sections is provided in the shaving surface. The edges of this partition groove are formed at a right angle. In other words, the partition groove shows an angled-U-shape cross section. The two shaving sections thus obtained by the partition groove are provided with many radial slits.

Since the partition groove for dividing the shaving surface of this external cutting member is simply concaved with sharp edges, pieces of hair and the oil that is secreted from the skin tend to accumulate easily in the partition groove, thus making it unsanitary. In addition, the process for making the angled-U-shaped groove is troublesome.

Furthermore, the hair that enters into the partition groove may bend when the hair comes in contact with the bottom of the groove. As a result, a smooth shaving is often hindered.

On the other hand, while the external cutting member as described above may be made by pressing, it is difficult to form the slits with high precision.

SUMMARY OF THE INVENTION

Accordingly, it is a primary object of the present invention to provide an electric razor that can smoothly bring the hair into the slits.

The object of the present invention is accomplished by a unique structure for an electric razor that includes a plurality of external cutting members (or shear plates), each of which is provided with radial slits for hair entry on the round shaving surface, and a plurality of internal cutting members, each of which is for cutting the hair entered through the slits while sliding along the inner surface of the shaving surface of the external cutting member.

The round shaving surface of the external cutting member is divided into a plurality of circular sections via one or more partition grooves that are formed concentrically with the center of the round shaving surface. The round shaving surface is provided with first radial slits at regular intervals in the shaving surface with the lengths ranging from the outermost shaving section to the innermost shaving section as well as the partition grooves(s). In addition, between these first slits, second slits of other lengths are also provided. These second slits include those which open from the outer edge of the round shaving surface up to the innermost partition groove and those which open from the outer edge of the round shaving surface up to the partition groove located outside the inner most partition groove. In other words, the external cutting member of the present invention has slits which are uneven in length corresponding to the number of shaving sections formed on the round shaving surface.

The slits are substantially in a radial direction. In other words, inward imaginary lines of each one of the slits is set so as not to intersect the center of the round shaving surface of the external cutting member. The cross section of the partition groove may have a V-shape or a U-shape, thus having a narrow bottom. Furthermore, the cutters of the internal cutting member that slide along the inner (or back) surface of the shaving surface may have a size that can cover at least one partition groove and have a concave-edge at a portion that corresponds to the partition groove of the external cutting member. In other words, the cutting edge of the cutters provided on the internal cutting member may have a wave shape so that it conforms with the cross sectional configuration of the partition groove(s) of the external cutting member.

Because the slits are opened at appropriate intervals on the shaving surface ranging from the outermost shaving section to the innermost shaving section, and those shaving sections are obtained by a plurality of partition groove(s), the skin in contact with the external cutting member is partially stretched out by the partition groove(s). As a result, the hair can be brought into the slits and cut by the internal cutting member smoothly.

BRIEF DESCRIPTION OF THE DRAWINGS

FIG. 3 is a top view of one type of internal cutting member used in the electric razor of the present invention;

FIG. 4 is a front view of the electric razor according to the present invention; and FIG. 5 is a sectional view illustrating the relationship between the cutter of another type of internal cutting member and the external cutting members.

DETAILED DESCRIPTION OF THE INVENTION

A detailed description of the present invention will be described below with reference to the accompanying drawings.

As shown in FIG. 4, three external cutting members (or shear plates) 12 are disposed in a form of a reversed-triangle on the external cutting member mount 11 which is at the upper portion of the casing of an electric razor 10.

Figure 1:
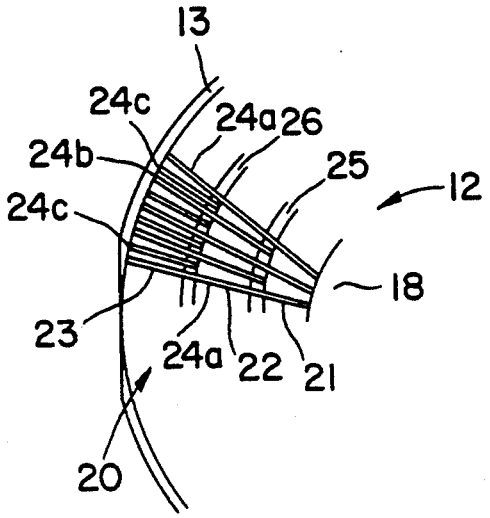
FIG. 1 is a partial top view of the external cutting member for an electric razor according to the present invention.
Figure 2:
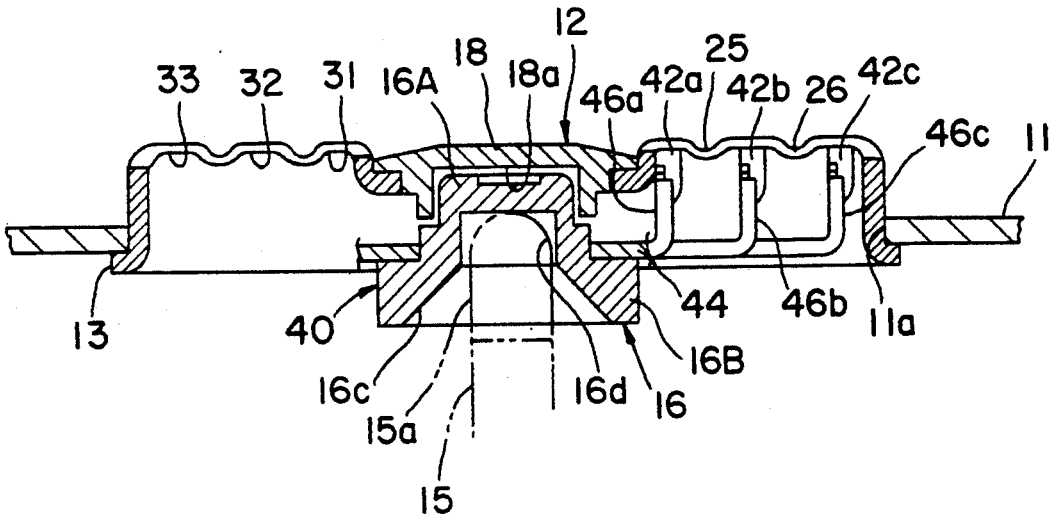
FIG. 2 is a sectional view illustrating the internal and external cutting members as assembled together.

As shown in FIG. 2, the external cutting member is a shallow cylinder with a top as a whole. At the center of the round external cutting member 12, a center cover 18 is fixed. The head of a drive transmission block 16 that is fixed to the center of an internal cutting member 40 is inserted in the center cover 18. The circumferential edge on the open side (or the underside) of the external cutting member 12 is provided with an outward flange 13. The flange 13 prevents the external cutting member 12 from coming out of the casing of the razor 10 after it is fitted into a through hole 11*a* from inside of the external cutting member mount 11.

Those areas not covered by the center cover 18 are shaving surface 20 that comes into contact with the skin when the shaving is performed. The shaving surface 20 is concentrically divided into three circular shaving sections by grooves. Starting from the one closest to the center of the shaving surface 20, the three sections are called: an innermost shaving section 21, an intermediate shaving section 22, and an outermost shaving section 23. These shaving sections are divided (or partitioned) by concentric circular partition grooves 25 and 26. The partition grooves 25 and 26 are the shallow U-shape depressions, which has round bottoms. They can also be shallow V-shape depressions. These sectional shapes are for the purpose of obtaining narrow bottoms in the grooves 25 and 26.

Each of the partition grooves protrudes to the back of the external cutting member 12, and the back of the shaving sections 21, 22 and 23 are defined as circular tracks, respectively, which are concentric also. These tracks are: an innermost track 31, an intermediate track 32, and an outermost track 33 into which the cutters of the internal cutting member 40 (described below) are fitted respectively.

The shaving surface 20 is provided with uneven length slits that cross the shaving sections 21, 22 and 23 in different manners. Given below is a description of the slits.

There are three types of slits which are opened substantially in the radial direction. The slits differ in length so that they correspond to the number of the circular shaving sections 21, 22 and 23.

The first slits 24*a* are laid out rectilinearly and cross not only all the three shaving sections 21, 22 and 23 but also the partition grooves 25 and 26. Thus, they are the longest among the three.

The second slits 24*b* are opened between two first slits 24*a*, and they are laid out to cross the shaving sections 22 and 23 and the partition groove 26.

The third slits 24*c* are opened between the first slit 24*a* and the second slit 24*b*, crossing only the outermost shaving section 23. Thus, they are the shortest among the three.

These slits 24*a*, 24*b* and 24*c* are formed for the entire shaving surface 20 with a predetermined interval. The ratio of the number of the slits on each one of the shaving sections 21, 22 and 23 is 1:2:4, when the number of the slits on the innermost shaving section 21 is set as 1.

When the three shaving sections are compared with each other in its surface area, the innermost shaving section 21 on the center side is the smallest, and the surface area increases as the location of the shaving section comes closer to the outer side. Accordingly, a larger number of slits are formed on the shaving sections located on the outer side.

A description of the internal cutting member that is used together with the outer cutting member described above will be provided below with reference to FIGS. 2 and 3.

The internal cutting member 40 is provided with three rows of cutters: the innermost cutters 42*a*, the intermediate cutters 42*b* and the outermost cutters 42*c*. These cutters differ in position from the center of the inner cutting member 40 in view of the arms 46*a*, 46*b* and 46*c* that are uneven in length. The cutters 42*a*, 42*b* and 42*c* provided at the end of the arms 46*a*, 46*b* and 46*c*, respectively, can fit in the three circular tracks 31, 32 and 33 of the external cutting member 12.

More specifically about the internal cutting member, at the center of the circular plate 44 that is a main body of the internal cutting member 40, the drive transmission block 16 is fixed. This drive transmission block 16 has a guiding unit 16A and a drive transmission unit 16B.

The guiding unit 16A sticks out above the circular plate 44, and the drive transmission unit protrudes downwardly. In addition, the guiding unit 16A is inserted and guided into the internal depression of the center cover 18, and the drive transmission unit 16B is formed with a conical lead-in recess into which the head of a drive shaft 15 for transmitting the power from a driving power source (not shown) is fitted. Also, the drive transmission unit 16B has a fitting portion 16*d* that is above the guiding portion 16*c*. The flat head portion 15*a* at the upper end of the driving shaft 15 fits in the fitting portion 16*d*.

From the periphery of the circular plate 44, arms of different or uneven length for mounting the cutters 42*a* (shortest), 42*b* (intermediate) and 42*c* (longest) are extended at regular intervals.

The cutter 42*a* is located at the position closest to the center and provided on the shortest arm 46*a* in a form so as to rise from the arm 46*a*. The innermost cutters 42*a* are fitted and rotated in the innermost circular track 31.

The intermediate cutters 42*b* are provided in a form so as to rise from the tip end of the arms 46*b*, which are of an intermediate length compared to the other arms. The cutters 42*b* are to fit into the intermediate circular track 32 located in the middle.

The cutters 42*c* are provided in a form so as to rise from the tip end of the arms 46*c*, which are of the longest compared to the other arms. The cutters 42*c* are fitted and rotated in the outermost circular track 33 located in the outermost portion of the external cutting member 12.

FIG. 5 shows different type of internal cutting member according to the present invention.

The cutter 48 (only one is shown) of the internal cutting member 40 in FIG. 5 has a width sufficient for sliding along the inner surfaces of the three circular tracks of the external cutting member 12. The cutter 48 is provided at the tip of the arm 49 extending from the circular plate 44 of the internal cutting member 40.

The cutter 48 has a cutting edge 48*a* on its upper edge so as to slide along the inner surfaces of the circular tracks 31, 32 and 33 as well as the inner surfaces of the partition grooves 25 and 26. The portions that correspond to the partition grooves 25 and 26 are formed into a concave shape so as to conform with the inner configuration of the partition grooves 25 and 26. Thus, the cutter 48 shown in FIG. 5 has a wave cutting edge, and a plurality of cutters of this shape are provided on the internal cutting member 40 at regular intervals by way of arms 49.

In this embodiment, the cutter has a width that can cover all the inner (or back) surfaces of the shaving surface 20. However, the width may be set so as to be enough to span at least one partition groove 25 or 26, that is, the width that covers only the circular tracks 31 and 32 of the external cutting member 12 or covers only the circular tracks 32 and 33 of the external cutting member 12. In this case, respective cutters may be supported by arms that differ in length and are bent upwardly (in the drawing) from the circular plate 44.

With the use of the internal cutting member that has cutters as shown in FIG. 5, longer hair that enters through the slits opened in the partition grooves 25 and 26 are cut by the cutting edge 48*a* that is formed for the entire width of the cutter 48. The hair that has been cut in the partition grooves 25 and 26 is further cut shorter when entered through the slits formed on the shaving surface 20.

Though the shaving surface 20 is divided into three (or triple) concentric circular shaving sections in the foregoing embodiments, the external cutting member can have double, quadruple, or quintuple concentric circular shaving sections. In this case, the internal cutting member has two, four or five rows of cutters on the uneven length arms extending outwardly form the internal cutting member. In addition, the difference in the length of the slits can depend upon the number of shaving sections and circular tracks.

In addition, though the invention has been described in various ways on its most preferable embodiments, it should be understood that the present invention is not limited to the embodiments described above, and various changes and modifications may be made in the invention without departing from the spirit and the scope of the invention. Such includes the cutters of the internal cutting member being in various different shapes as far as they can fit in the circular tracks of the external cutting member.

As described above, the electric razor according to the present invention has slits opened in the concentric circular shaving sections as well as in the partition grooves of the surface of each one of the external cutting members for an electric razor. Therefore, it can be kept in a sanitary condition since pieces of hair and the oil that is secreted from the skin are hardly accumulated in the partition groove. Furthermore, since the partition groove are in a U- or V-shape in a cross section, the accumulation of the pieces of hair and oil is more efficiently avoided.

Also, because the slits are opened in the partition groove(s) and the cutters are provided so as to cut the hair led in through the slits of the partition groove(s), a large surface area can be secured for shaving the hair.

In addition, since the skin is stretched out by the inner and outer surfaces of the partition groove(s), a deep shave is possible. Furthermore, with the use of the electric razor of the present invention, the hair, that would have been impossible to be brought in through the slits of conventional razors in which the hair merely comes into contact closely with the shaving surfaces, is first cut when brought into the slits of the partition groove(s), and then further cut on the shaving surface that comes into contact closely with the skin. Thus, a very clean cut of the hair is obtained. In addition, with the partition groove(s) in a U-shape or V-shape, the hair can be drawn in more smoothly.

We claim:

1. An electric razor comprising an external cutting member, which is provided with radial slits for bringing hair under a round shaving surface, and an internal cutting member which is for cutting said hair that is led through said slits while sliding along an inner surface of said external cutting member; wherein said round shaving surface is divided into concentric plural sections via one or more circular partition grooves provided concentrically with a center of said shaving surface;

said external cutting member is integrally formed as one integral unit; and said slits are opened at predetermined intervals in surfaces ranging from an outermost shaving section to an innermost shaving section and through said partition grooves, and said slits are further opened between each of said opened slits so as to be formed in the range up to an innermost partition groove or up to a partition groove located outside said innermost partition groove.

2. An electric razor according to claim 1, wherein said partition groove is formed to have a narrowed bottom.

3. An electric razor according to claim 2, wherein said internal cutting member that slides along the inner surface of said shaving surface of said external cutting member is provided with cutters, each one of said cutters being formed to have a size spanning at least one partition groove, a portion of said internal cutting member corresponding to said partition groove of said external cutting member being formed into a recess so as to conform with sand slide along a configuration of said partition groove, and said internal cutting member is integrally formed as one member.

4. An electric razor according to claim 1, wherein said internal cutting member that slides along the inner surface of said shaving surface of said external cutting member is provided with cutters, each one of said cutters being formed to have a size spanning at least one partition groove, a portion of said internal cutting member corresponding to said partition groove of said external cutting member being formed into a recess so as to conform with and slide along a configuration of said partition groove, and said internal cutting member is integrally formed as one member.

5. An electric razor according to claim 4 wherein said electric razor is provided with three pairs of external cutting and internal cutting members.

6. An electric razor comprising a plurality of external cutting members and a plurality of internal cutting members, in which:

a round top of each one of said external cutting members is divided into three concentric circular shaving sections via two circular grooves formed concentrically with a center of said external cutting member, the backs of said three shaving sections being defined as circular tracks;

each of said plurality of said external cutting members is integrally formed as a unitary member;

first slits for hair entry are opened on said round top at predetermined intervals in a circumferential direction of said internal cutting member, said slits being opened so as to cross said three shaving sections and said two circular partition grooves;

second slits for hair entry are opened on said round top at predetermined intervals in a circumferential direction of said internal cutting member, each one of said second slits being opened between said first slits and crossing outer two concentric circular shaving sections and an outer circular groove;

third slits for hair entry are opened at predetermined intervals in a circumferential direction of said external cutting member, each one of said third slits being opened between one of said first slits and one of said second slits and crossing only an outermost shaving section;

said internal cutting member is provided with cutters at ends of arms extending outwardly in three different length so that said cutters fit in said three circular tracks of said external cutting member; and said internal cutting member is integrally formed as one member.

7. An electric razor according to claim 6, wherein each one of said partition groove has a U-shaped cross section.

8. An electric razor according to claim 6, wherein each one of said partition groove has a V-shaped cross section.

9. An electric razor according to claim 6, wherein said internal cutting member has a plurality of arms extending outwardly and cutters at ends of said arms, each one of said cutters having a cutting edge which has a width equal to a width of back surface of said shaving surface.

10. An electric razor according to claim 9, wherein said cutting edge has a wave shape so as to conform with a configuration of said back surface of said shaving surface.

11. An electric razor according to claim 6, wherein said slits are provided so that inwardly extending imaginary lines of said slits do not intersect a center of said external cutting member.

* * * * *